US007178844B2

(12) United States Patent
Evilsizer

(10) Patent No.: US 7,178,844 B2
(45) Date of Patent: Feb. 20, 2007

(54) GOLF BALL RETRIEVER

(76) Inventor: Brian Evilsizer, 2920 S. Bay Dr., Westlake, OH (US) 44145

( * ) Notice: Subject to any disclaimer, the term of this patent is extended or adjusted under 35 U.S.C. 154(b) by 0 days.

(21) Appl. No.: 10/977,747

(22) Filed: Oct. 29, 2004

(65) Prior Publication Data

US 2006/0091681 A1 May 4, 2006

(51) Int. Cl.
*A63B 47/02* (2006.01)

(52) U.S. Cl. ..... 294/19.2; 473/286

(58) Field of Classification Search ..... 294/19.1, 294/19.2; 473/286, 285, 340, 460, 464; 56/328.1; D21/720, 721, 796
See application file for complete search history.

(56) References Cited

U.S. PATENT DOCUMENTS

| | | | | | |
|---|---|---|---|---|---|
| 2,561,815 | A | | 7/1951 | Oberg | |
| 2,760,807 | A | * | 8/1956 | Watson | 294/19.2 |
| 2,810,252 | A | | 10/1957 | Kelley | |
| 3,026,666 | A | | 3/1962 | Baugh, Jr. | |
| 3,046,044 | A | | 7/1962 | Christle | |
| 3,136,573 | A | * | 6/1964 | Harke | 294/19.2 |
| 3,442,544 | A | | 5/1969 | Faber | |
| 3,770,308 | A | | 11/1973 | Faber et al. | |
| 3,887,225 | A | | 6/1975 | McKee | |
| 3,922,026 | A | | 11/1975 | Schweitzer | |
| 3,982,781 | A | | 9/1976 | Tucker et al. | |
| 4,063,769 | A | | 12/1977 | Zimmer | |
| 4,073,529 | A | | 2/1978 | Ostrin | |
| 4,493,503 | A | | 1/1985 | Jeninga | |
| D283,432 | S | * | 4/1986 | Rosenow | D21/721 |
| 4,580,784 | A | * | 4/1986 | Brill | 473/286 |
| 4,659,125 | A | | 4/1987 | Chuan | |
| 4,674,747 | A | * | 6/1987 | Mazzocco et al. | 473/296 |
| 4,678,108 | A | * | 7/1987 | Inman | 294/19.2 |
| 4,728,134 | A | | 3/1988 | Allen | |
| 4,787,632 | A | | 11/1988 | Nigrelli et al. | |
| D306,058 | S | | 2/1990 | Blake | |
| 4,964,665 | A | | 10/1990 | Crow | |
| 5,165,744 | A | * | 11/1992 | Vogrin | 294/19.2 |
| 5,188,409 | A | | 2/1993 | Ferey | |
| 5,188,410 | A | * | 2/1993 | Summers | 294/19.2 |
| 5,265,926 | A | | 11/1993 | DiNardo | |
| 5,326,005 | A | * | 7/1994 | Fisher | 224/661 |
| 5,437,487 | A | | 8/1995 | Fulop | |
| 5,651,571 | A | | 7/1997 | Diveto | |
| 5,662,366 | A | | 9/1997 | Fraske | |
| 5,692,968 | A | * | 12/1997 | Shine | 294/19.2 |
| D402,724 | S | | 12/1998 | Minami | |
| 5,863,258 | A | | 1/1999 | Fulop | |

(Continued)

*Primary Examiner*—Eileen D. Lillis
*Assistant Examiner*—Paul T. Chin
(74) *Attorney, Agent, or Firm*—Tarolli, Sundheim, Covell & Tummino LLP

(57) ABSTRACT

The ball retriever includes a golf ball capturing housing having an entrance plane through which a golf ball can enter the housing. The entrance plane is defined by a first wall portion and a second spaced apart second wall portion where at least a portion of the housing moves to permit the golf ball to pass through the entrance plane and capture the ball within the housing. One of the wall portions can include a ridge disposed in close proximity to the entrance plane wherein the distance between the ridge and an opposing wall portion is smaller than the diameter of the golf ball such that the opposing wall moves to permit the ball to pass through the entrance, across the ridge and in to the housing.

5 Claims, 4 Drawing Sheets

U.S. PATENT DOCUMENTS 5,921,598 A * 7/1999 Bredow ..... 294/19.2
6,120,387 A 9/2000 Bobst
6,257,635 B1 7/2001 Torelli
6,293,397 B1 * 9/2001 Chen ..... 206/315.9
6,437,487 B1 * 8/2002 Mohr et al. ..... 310/365
D478,642 S * 8/2003 Spino ..... D21/736
6,638,177 B1 * 10/2003 Wang ..... 294/19.2
7,059,971 B1 * 6/2006 Schmitt ..... 473/285

* cited by examiner

GOLF BALL RETRIEVER

FIELD OF THE INVENTION

The present invention relates generally to golf equipment and, more specifically, to a golf ball retriever.

BACKGROUND

In the game of golf, various obstacles are present on the course to make play more challenging to the golfer. Such obstacles include overgrown vegetation, sand traps, and water hazards. During play, it is likely that a golfer will encounter one of the obstacles on the course and have his ball encumbered by such obstacles. In certain circumstances, the ball can be seen, but not conveniently reached as when a ball comes to rest in a water hazard. The golfer is then confronted with either losing an often times expensive golf ball or employing an implement to retrieve the ball from the obstacle. One such implement is disclosed in U.S. Pat. No. 5,437,487 to Fulop which employs a retaining device having a spring that is displaced upon entry of the golf ball in the retaining device. Once the ball completely passes through the entrance plane, the spring returns to its original position thus capturing the ball in the retaining device. U.S. Pat. No. 4,493,503 to Jeninga captures a ball with a pair of bail members that allow the ball to pass through to a stop and by their own weight return to their normal resting position to capture the ball between the bail members. Other patents employ a cup member (U.S. Pat. No. 6,921,598 to Bredow) or a cylinder in which a golf ball is permitted to pass through an elastic member to be captured within the cylinder (see U.S. Pat. No. 6,120,387 to Bobst).

These prior designs are large and cumbersome and are difficult to maneuver in place over a golf ball when retrieving. Thus, the need exists for a golf ball retriever that avoids the shortcomings of prior designs.

SUMMARY

By eliminating the complex designs, which include bail members, springs, elastic materials and the like, the golf ball retriever of the present invention is easier to use, more compact and more securely captures a golf ball upon retrieval. The present invention relates to a unique golf ball retrieving device.

In a preferred embodiment, the ball retriever includes a golf ball capturing housing having an entrance plane through which a golf ball can enter the housing. The plane is defined by a first wall portion and a spaced apart second wall portion where at least a portion of the housing moves to permit the golf ball to pass through the entrance plane and capture the ball within the housing. The golf ball retriever may also include a handle which allows the user to reach areas beyond normal reach. In one embodiment, the handle is a telescopic handle. In another embodiment, the movement of the wall portions may be accomplished by flexion of a wall or housing. In yet another embodiment, one of the wall portions can include a ridge disposed in close proximity to the entrance plane wherein the distance between the ridge and an opposing wall portion is smaller than the diameter of the golf ball such that the opposing wall moves to permit the ball to pass through the entrance, across the ridge and in to the housing.

In a preferred embodiment of the present invention, the first wall portion and second wall portion are integrally formed with a cup shaped top portion to form a shell which can house the golf ball upon capturing. In another embodiment, the top portion includes a hole having a diameter greater than that of a golf ball so the once the ball is captured it can be expelled from the shell to a desired location through the hole.

The shell in preferably constructed from a polyurethane. However other compositions are contemplated. Such compositions include a mixture of polyvinyl chloride and polyurethane. Preferably, the mixture is about 50% polyvinyl chloride and about 50% polyurethane. The shell can be molded from injection molding or formed through other molding techniques commonly employed with thermoplastic materials.

DETAILED DISCLOSURE

Figure 1:
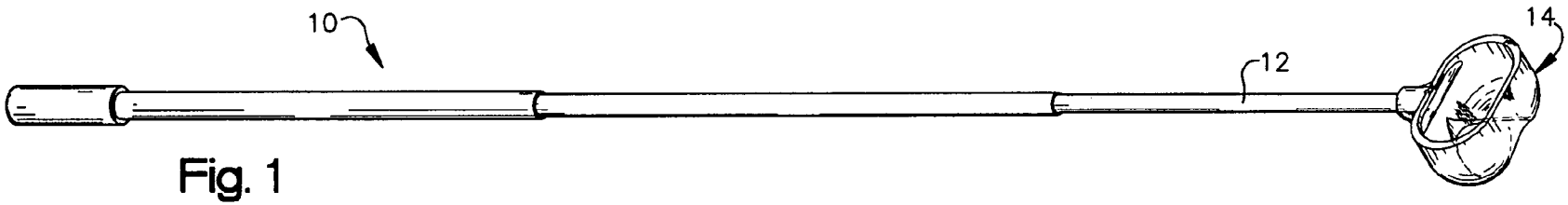
FIG. 1 is a perspective view of a golf ball retriever incorporating a capturing device of the present invention.
Figure 2:
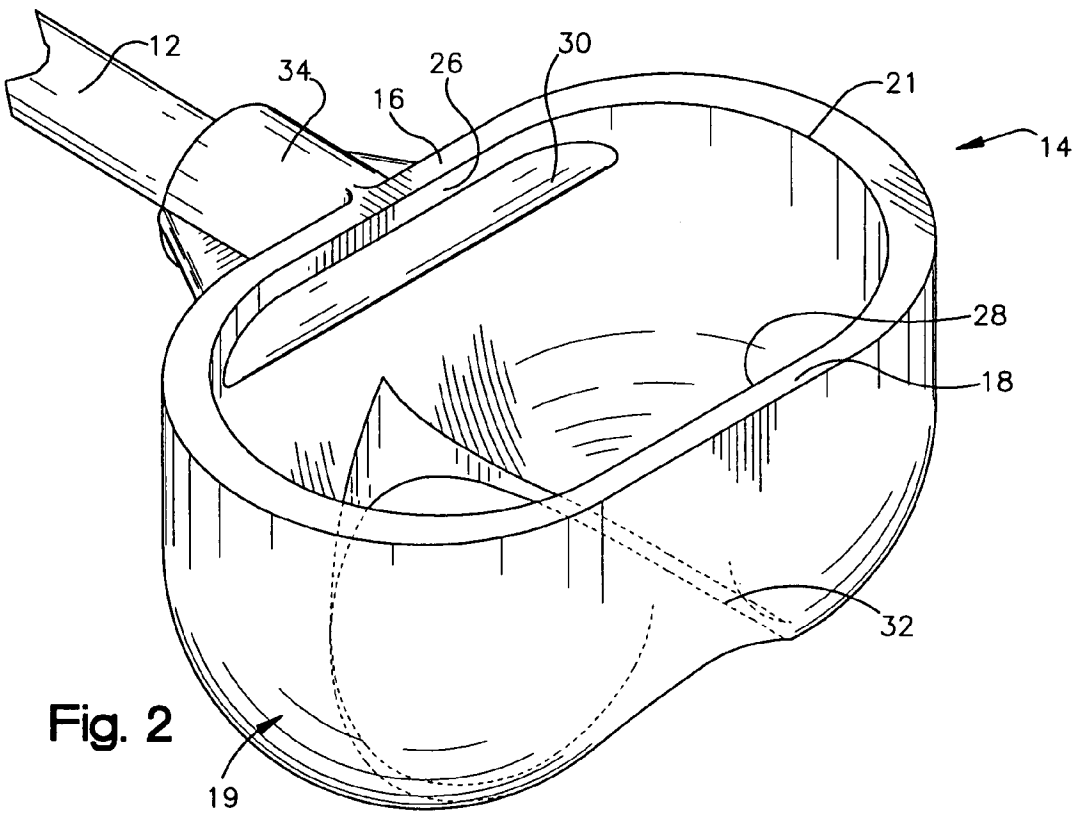
FIG. 2 is a perspective view of the bottom of a capturing device according to the present invention.

FIG. 1 shows a golf ball retriever 10 that includes a handle 12 having affixed thereto a capturing device generally shown as reference character 14.

FIGS. 2–5 show the features of the capturing device 14 in more detail. The capturing device includes an opening defined by a generally C-shaped first wall 16 and an opposing generally C-shaped second wall 18. The first wall 16 and the second wall 18 are integrally connected to a cup shaped top portion 20 (shown best in FIG. 3). The wall 16 and 18 are symmetrical in shape and are situated in opposing positions such that together they create an oblong or "race track" shaped entrance 21 at the bottom of the capturing device 14 for capturing a golf ball 24. The first wall 16, the second wall 18 and the cup-shaped top 20 are integrally formed together to create a shell 19 which captures and retains a golf ball 24.

The shell 19 is molded as one piece through injection molding or other molding types as know to those of ordinary skill in the art of thermoplastics. The shell 19 is molded from a composition of polyvinyl chloride and polyurethane. One composition includes about 50% polyvinyl chloride and about 50% polyurethane. The ratio of polyvinyl chloride to polyurethane can vary depending on the properties, such as flexion of the wall of the shell, desired.

The first wall 16 includes a first flat longitudinal section 26 that faces the internal area of the shell 19. Opposing and generally parallel to the first flat longitudinal section 26 is a second flat longitudinal section 28 on the second wall 18. The flat longitudinal section 26 of the first wall 16 is separated from the second flat longitudinal section 28 of the second wall 18 by a distance that is greater than the diameter of a golf ball such that when a golf ball is present in the shell 19, it is free to move. The first flat longitudinal section 26 of the first wall 16 includes a longitudinal ridge 30 that protrudes away from the flat section 26 towards the interior of the shell 19. The ridge 30 runs generally for the length of the flat section 26 of the wall portion 16.

Figure 3:
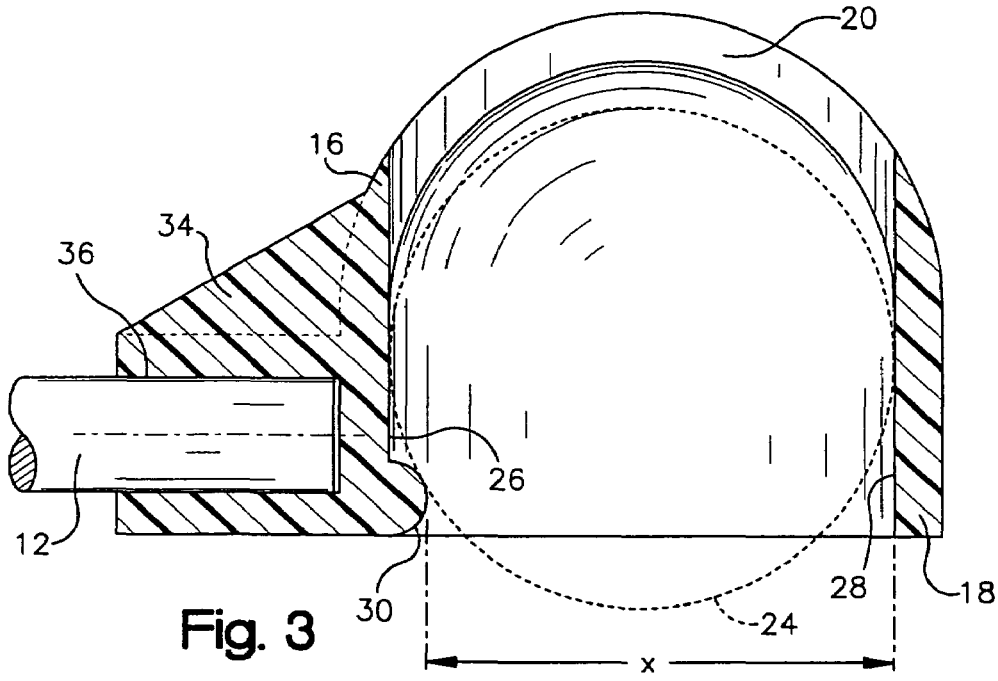
FIG. 3 is a cross-sectional view of the side of the capturing device shown in FIG. 2.
Figure 4:
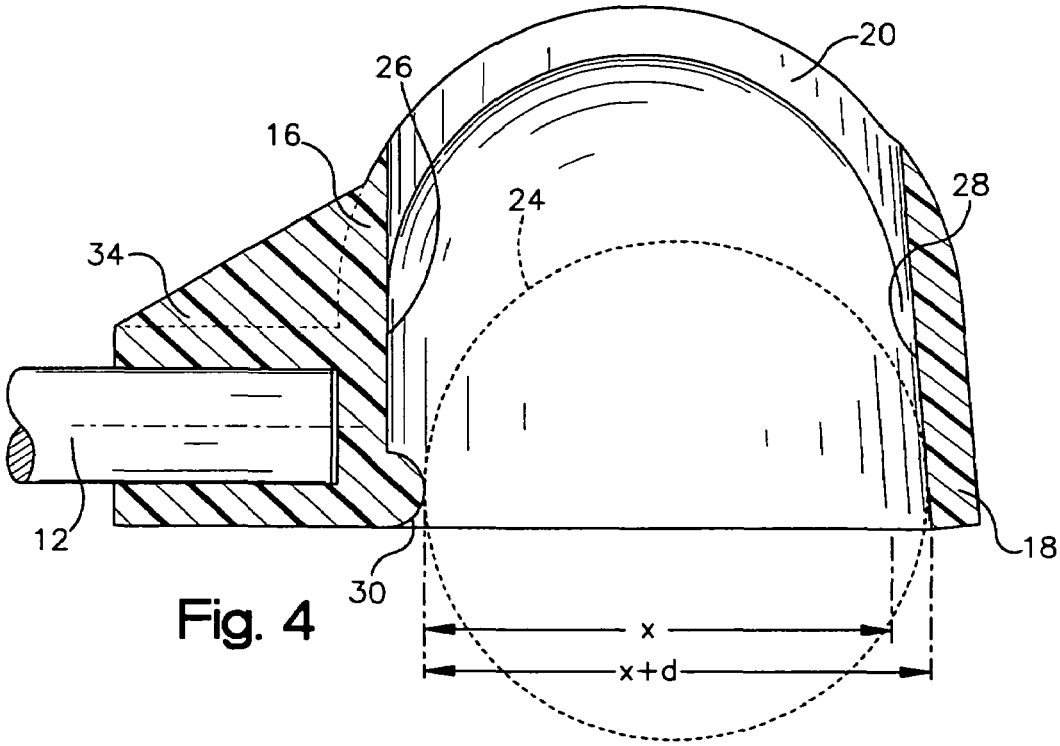
FIG. 4 is a cross-sectional view of the side of the capturing device shown in FIG. 2 with a golf ball in the capturing position.

Normally, when capturing a golf ball 24, the entrance 21 of the shell 19 is placed over the ball 24 and the capturing device 14 is urged downward on the golf ball 24. The distance between the ridge 30 and the second longitudinal wall 28 is less than the diameter of the golf ball and is equal to X (FIG. 3). The downward force of the capturing device 14 on the ball 24 causes the second wall 18 to flex or move away from the ball 24, thus increasing X by a distance d where d is equal to the difference between the diameter of the golf ball 24 and the normal non-capturing distance X between the ridge 30 and the second wall section 28, to accommodate the golf ball (See FIG. 4). Although it is described that the second wall deforms or flexes to accommodate the ball 24, it is noted that because the first wall 16, the second wall 18 and cup-shaped top 20 are molded as one unit, when capturing the golf ball 24 all three sections can deform to accommodate the ball 24 entering through the entrance 21.

Figure 5:
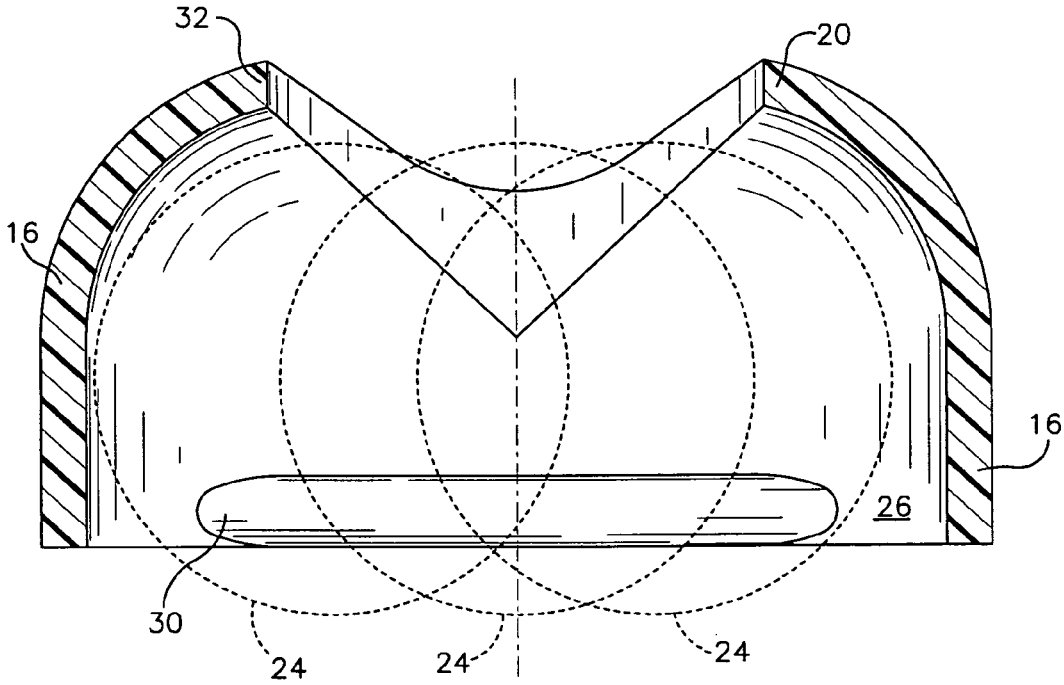
FIG. 5 is cross-sectional view of the capturing device of FIG. 2 shown from a side

Continued downward force causes the center of the ball having its greatest diameter to ride over the ridge 30 by flexion of the second wall 18 and enter the shell 19 of the capturing device 14. Once the center of the golf ball 24 is beyond the ridge 30, the wall 18 un-flexes and reverts back to its original position thus capturing the golf ball 24 within the shell 19. When the ball 24 is captured within the shell 19, it can move about freely due to the distance between the first flat section 26 and the second flat section 28 being larger than the diameter of the ball 24, as described. FIG. 5 shows various positions of the ball 24 within the shell. A ball can take any of these positions or any other position between the within the shell 19.

As illustrated, the cup-shaped top portion 20 has a generally round shaped opening 32 at an opposing end from the entrance 21 of the shell 19. The opening 32 has a diameter greater than that of a golf ball 24. Therefore, once a ball is captured within the shell 19, the capturing device 14 can be turned end for end or upside down allowing the ball to exit the shell through the opening 32 in the top 20.

Further, the first wall 16 has an integrally formed attachment section 34 that extends perpendicularly away form the first wall 16. The attachment section 34 includes a bore 36 that accommodates an end of the handle 12. In the illustrated embodiment, the handle 12 is a telescopic handle as commonly used in the art. However, other types of handles are also contemplated. The handle 12 is secured in the bore 36 of the attachment section 34 with a glue or an adhesive. Alternatively, the handle 12 may be secured to the attachment section 34 through other means including mechanical means.

Figure 6:
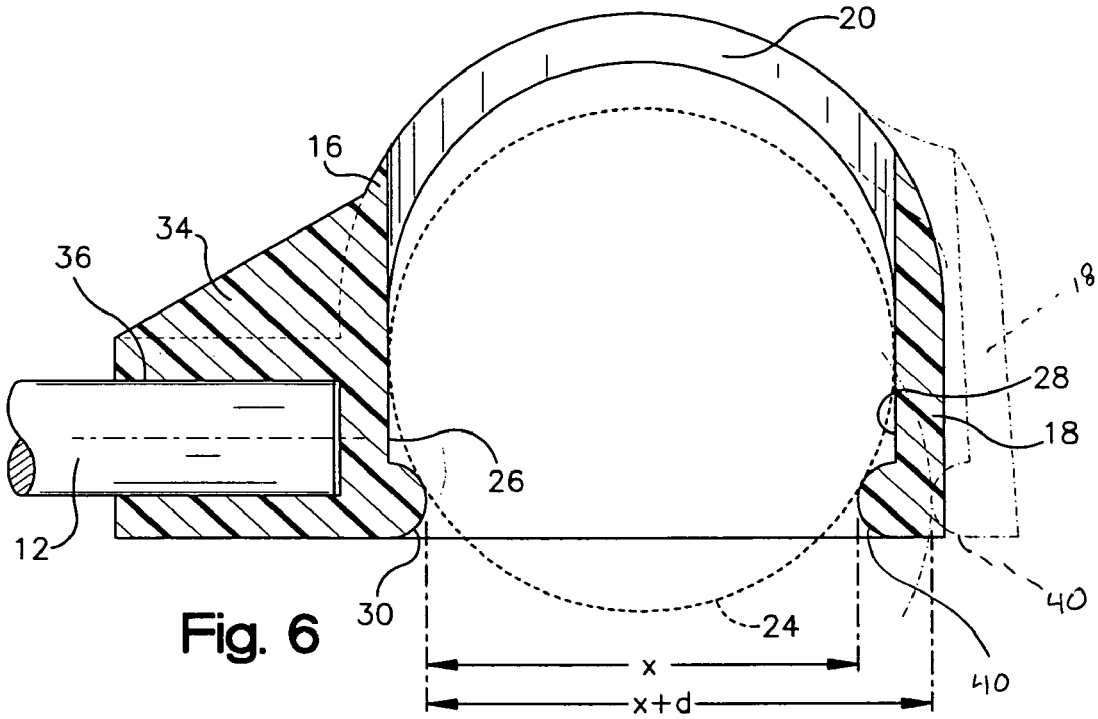
FIG. 6 is a cross-sectional view of the capturing device showing a separate embodiment having two longitudinal ridge portions.
Figure 7:
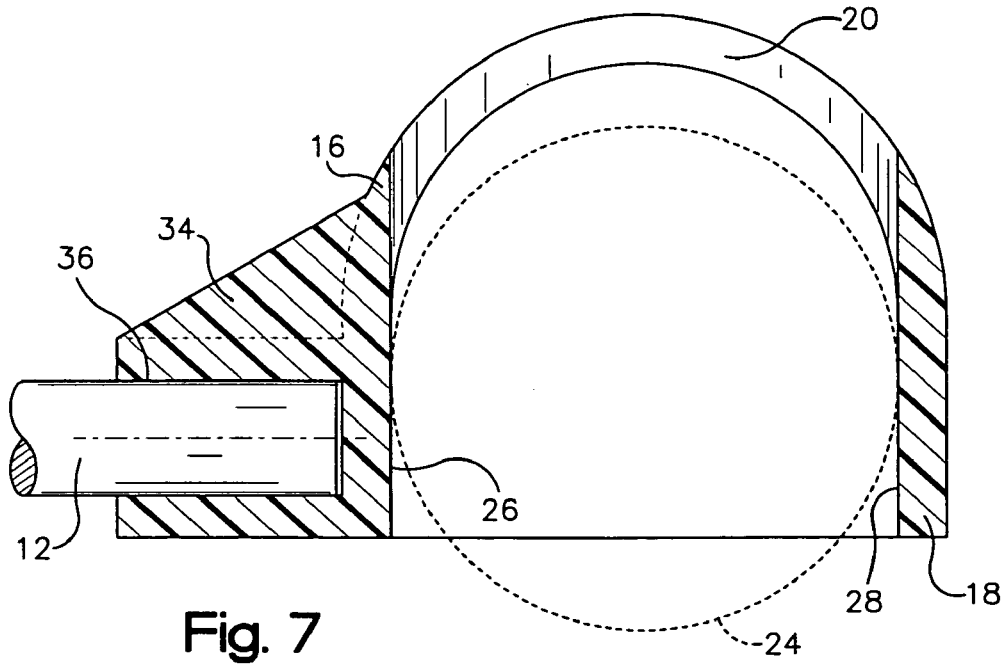
FIG. 7 is a cross-sectional view of the capturing device showing a separate embodiment having a first and second flat longitudinal sections.

Turning now to FIGS. 6 and 7, two alternative embodiments are illustrated. In FIG. 6, the first flat longitudinal section 26 includes a ridge 30 and the second flat longitudinal section 28 includes a second longitudinal ridge 40. The distance between the ridge 30 and the second ridge 40 is less than the diameter of a golf ball 24. In this embodiment, during the capturing operation, the wall 18 deforms or flexes, thus increasing X by a distance d, to accommodate the ball 24 passing between the ridge 30 and second ridge 40 (deformed wall 18 shown in phantom). As with the previous embodiments, the first longitudinal section 26 and the second flat longitudinal section 28 are separated by a distance greater than the diameter of the golf ball 24 to allow the golf ball 24 to move freely within the shell 19 once captured.

Turning now to FIG. 7, the capturing device does not include a ridge along the first flat longitudinal section 26 or the second flat longitudinal section 28. The distance between the first flat longitudinal section 26 and the second flat longitudinal section 28 is equal to or less than the diameter of the golf ball 24. During the capturing operation, the wall 18 deforms or flexes very slightly to allow the golf ball 24 to enter the shell 19. The golf ball 24 is held in the shell 19 by friction between the ball 24 and the first flat longitudinal section 26 and the second flat longitudinal section 28. The frictional force is caused by the slight deformation of the second wall 18 caused by the presence of the ball 24 within the shell 19. The ball 24 can be expelled from the shell 19 by a slight jerking movement either through the entrance 21 or hole 20.

Although the present invention has been described with a degree of particularity, it is the intent that the invention include all modifications and alterations from the disclosed design falling within the spirit or scope of the appended claims.

The invention claimed is:

1. A golf ball retriever comprising:

a golf ball capturing housing comprising:

i) a first C-shaped wall having a first longitudinal flat section;

ii) a second C-shaped wall having a second longitudinal flat section spaced apart and generally parallel to said first longitudinal flat section wherein the first longitudinal flat section and the second longitudinal flat section are spaced apart a distance greater than the diameter of a golf ball, and wherein said second C-shaped wall is integrally molded to said first C-shaped wall wherein the first C-shaped wall and the second C-shaped wall create a generally oblong entrance through which a golf ball can enter the capturing device;

iii) a cup-shaped top integrally molded to said first C-shaped wall and said second C-shaped wall and wherein the cup-shaped top portion, the first C-shaped wall and the second C-shaped wall together create a shell which houses a golf ball once it is captured, iv) a protruding ridge integrally molded to the first longitudinal flat section wherein the distance between the protruding ridge and the second flat longitudinal section is less than the diameter of a golf ball, and wherein at least a portion of the shell is displaced to permit the golf ball to pass through the entrance, over said ridge and into the shell;

v) an exit aperture substantially 180 degrees from said entrance from which a golf ball can be freely expelled through said exit aperture; and vi) an attachment portion integrally molded to the first C-shaped wall, said attachment portion including a bore for securing a handle.

2. The retriever of claim 1 wherein the shell is constructed from a mixture of polyvinyl chloride and polyurethane.

3. The retriever of claim 2 wherein the mixture comprises about 50% polyvinyl chloride and about 50% polyurethane.

4. The retriever of claim 1 wherein said movement is accomplished by displacement of the second C-shaped wall.

5. The retriever of claim 1 wherein said shell further comprises a first and second end such that a golf ball enters said first end through said entrance when said first end is positioned in a capturing orientation and the captured golf ball can be freely expelled out said second end through said exit aperture when the said shell is rotated 180 degrees from said capturing orientation to a release orientation.

* * * * *